US011173740B2

(12) United States Patent
Takahashi et al.

(10) Patent No.: US 11,173,740 B2
(45) Date of Patent: Nov. 16, 2021

(54) ERASING UNIT AND ERASING METHOD

(71) Applicant: Sony Corporation, Tokyo (JP)

(72) Inventors: Isao Takahashi, Kanagawa (JP); Satoko Asaoka, Kanagawa (JP); Taichi Takeuchi, Kanagawa (JP); Asuka Tejima, Kanagawa (JP); Kentaro Kuriyama, Kanagawa (JP); Mitsunari Hoshi, Kanagawa (JP)

(73) Assignee: Sony Corporation, Tokyo (JP)

( * ) Notice: Subject to any disclaimer, the term of this patent is extended or adjusted under 35 U.S.C. 154(b) by 104 days.

(21) Appl. No.: 16/624,127

(22) PCT Filed: May 11, 2018

(86) PCT No.: PCT/JP2018/018256
§ 371 (c)(1),
(2) Date: Dec. 18, 2019

(87) PCT Pub. No.: WO2018/235446
PCT Pub. Date: Dec. 27, 2018

(65) Prior Publication Data

US 2020/0230992 A1 Jul. 23, 2020

(30) Foreign Application Priority Data

Jun. 20, 2017 (JP) ..... JP2017-120739

(51) Int. Cl.
*B41M 7/00* (2006.01)
*B41J 2/475* (2006.01)
(Continued)

(52) U.S. Cl.
CPC ..... *B41M 7/0009* (2013.01); *B41J 2/4753* (2013.01); *B41M 5/30* (2013.01);
(Continued)

(58) Field of Classification Search
CPC ..... B41M 7/0009; B41M 5/30; B41M 5/34; B41M 2205/38; B41M 2205/04;
(Continued)

(56) References Cited

U.S. PATENT DOCUMENTS 5,161,233 A * 11/1992 Matsuo ..... G03G 5/02 355/77
2005/0225891 A1* 10/2005 Tsuboi ..... B41M 5/34 360/69
(Continued)

FOREIGN PATENT DOCUMENTS

JP 2004074584 A 3/2004
JP 2004155010 A 6/2004
(Continued)

OTHER PUBLICATIONS

International Search Report for Application No. PCT/JP2018/018256, dated Jun. 12, 2018.

*Primary Examiner* — Yaovi M Ameh
(74) *Attorney, Agent, or Firm* — K&L Gates LLP

(57) ABSTRACT

An erasing unit according to an embodiment of the present disclosure is a unit that performs erasing of information written on a reversible recording medium. This erasing unit includes: a light source section including one or a plurality of laser devices; and a controller that controls the light source section to cause the light source section to emit a smaller number of laser light beams having emission wavelengths than the number of the recording layers included in the reversible recording medium.

10 Claims, 8 Drawing Sheets

(51) Int. Cl.
*B41M 5/30* (2006.01)
*B41M 5/34* (2006.01)

(52) U.S. Cl.
CPC ..... *B41M 5/34* (2013.01); *B41J 2002/4756* (2013.01); *B41M 2205/04* (2013.01); *B41M 2205/38* (2013.01)

(58) Field of Classification Search
CPC ..... B41M 5/42; B41M 5/323; B41M 5/333; B41M 5/305; B41J 2/4753; B41J 2002/4756
See application file for complete search history.

(56) References Cited

U.S. PATENT DOCUMENTS

| | | | | |
|---|---|---|---|---|
| 2006/0276335 | A1* | 12/2006 | Tsuboi ..... | C09B 49/128<br>503/201 |
| 2013/0267413 | A1 | 10/2013 | Oshiro | |

FOREIGN PATENT DOCUMENTS

| | | | |
|---|---|---|---|
| JP | 2004188827 | A | 7/2004 |
| JP | 2005-205882 | | 8/2005 |
| JP | 2005205882 | A | 8/2005 |
| JP | 2007-098735 | | 4/2007 |
| JP | 2007098735 | A | 4/2007 |
| JP | 2011104995 | A | 6/2011 |

* cited by examiner

[ FIG. 1 ]
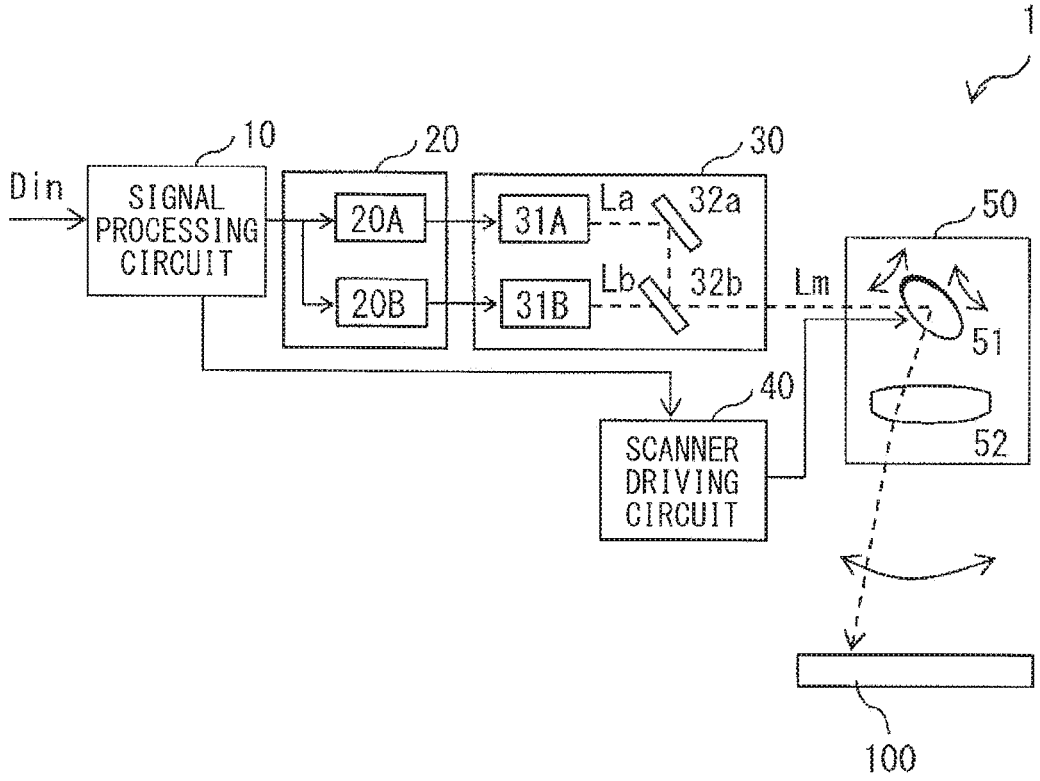
[ FIG. 2 ]
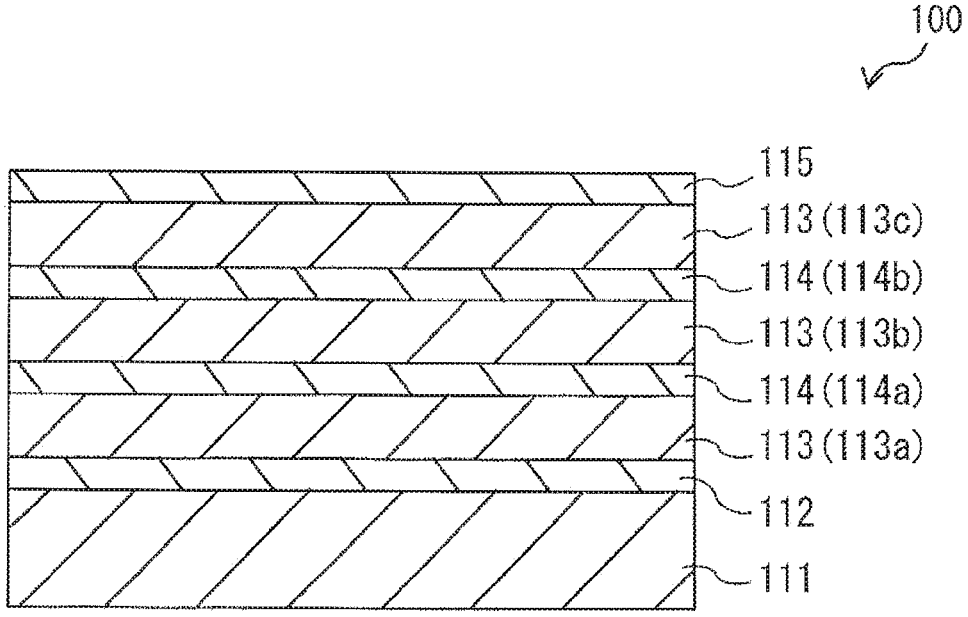

[ FIG. 3 ]
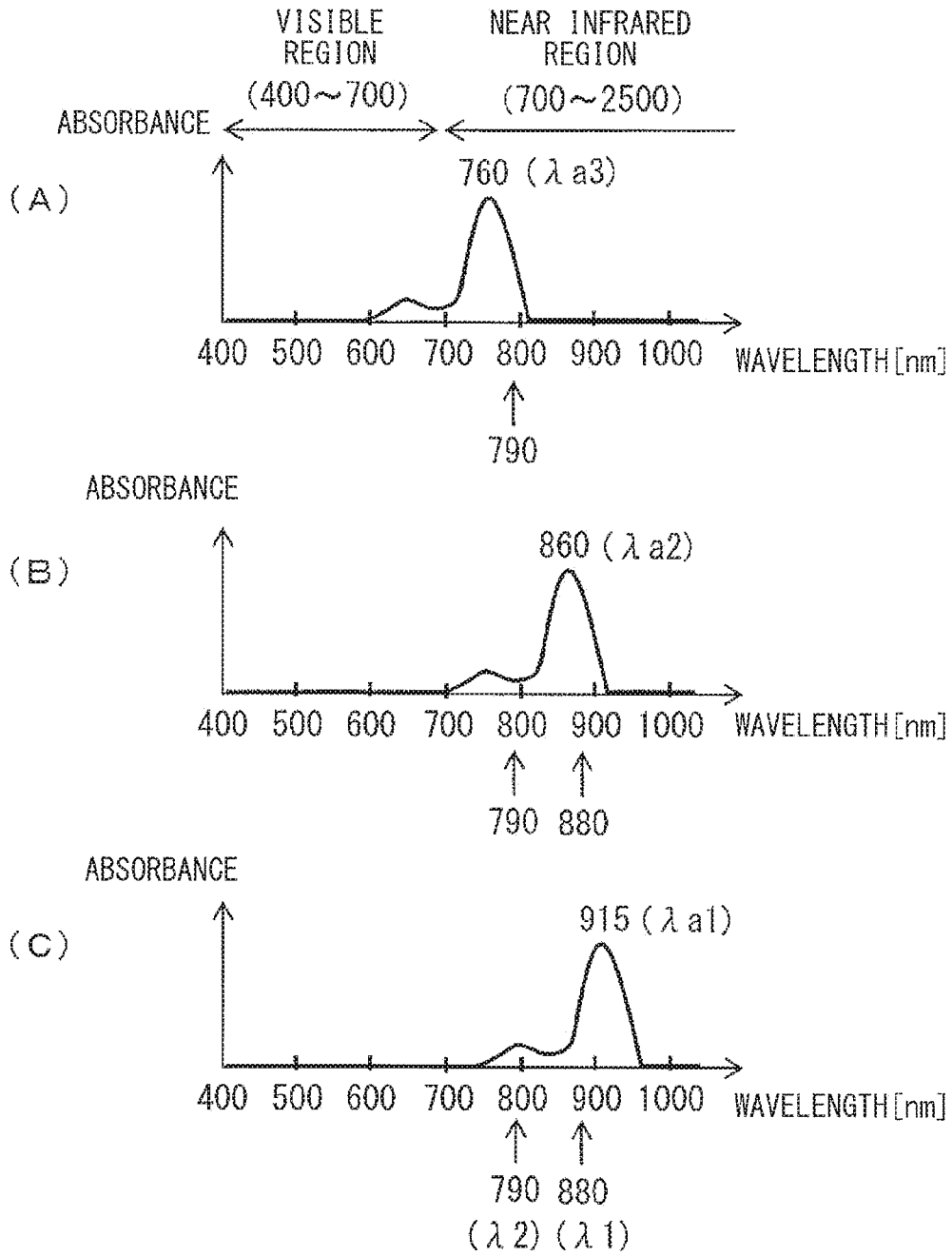

[ FIG. 4 ]
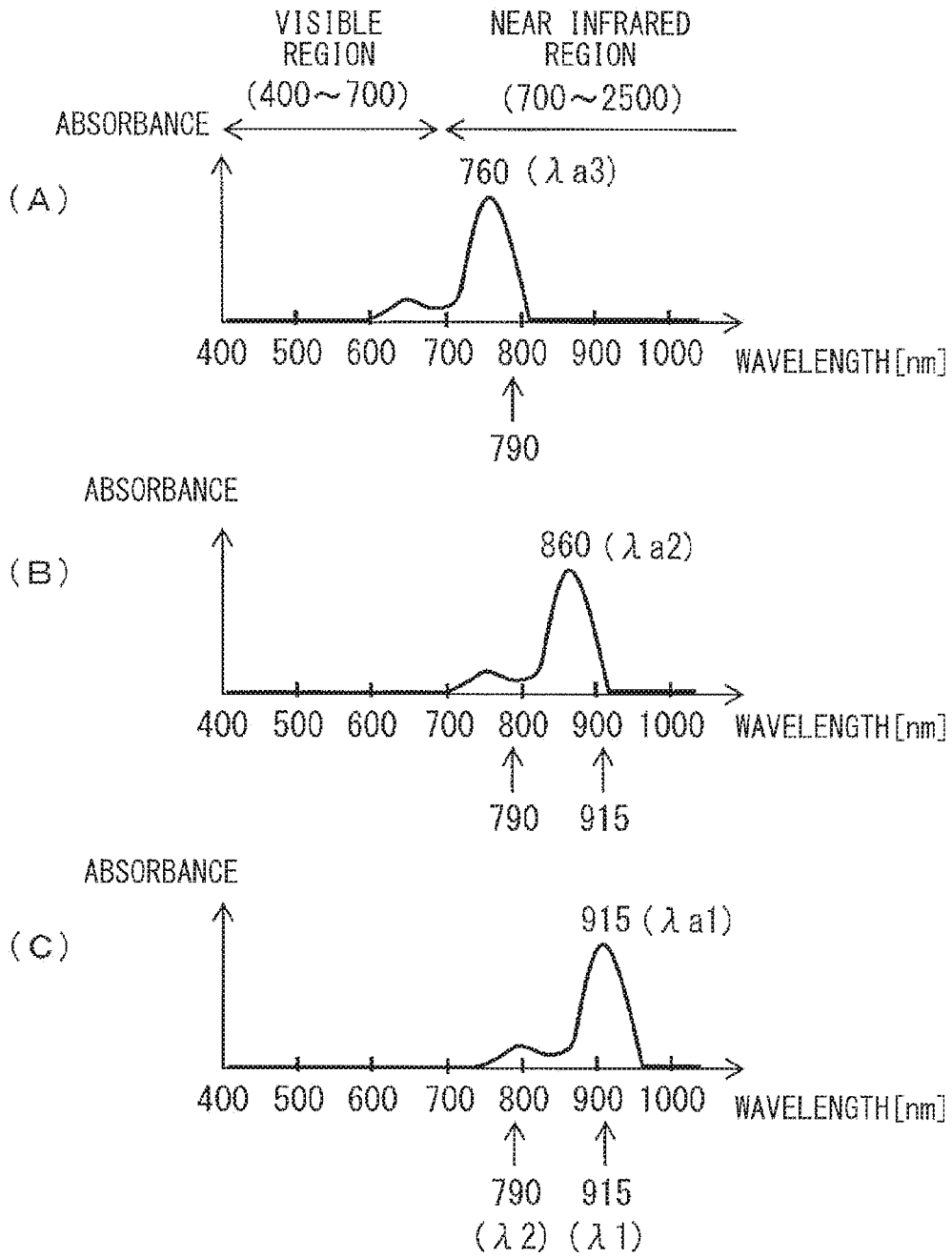

[ FIG. 5 ]
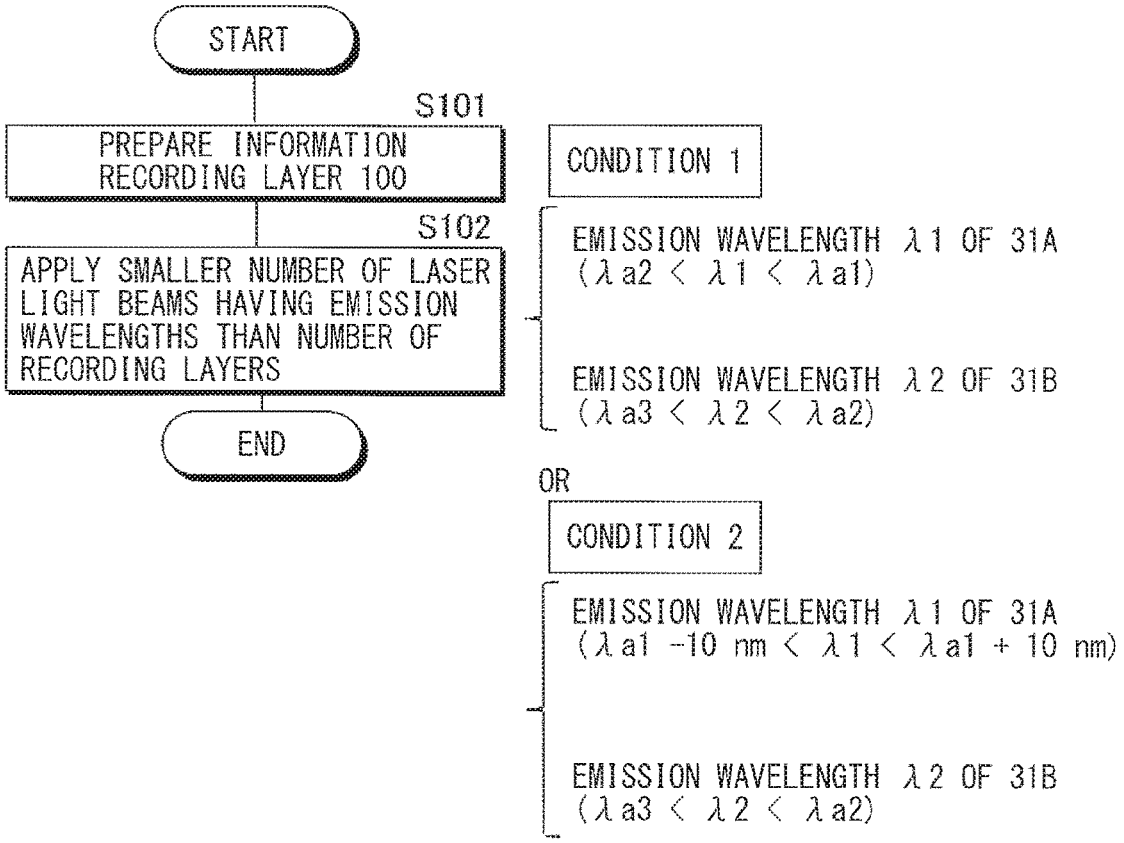
[ FIG. 6 ]
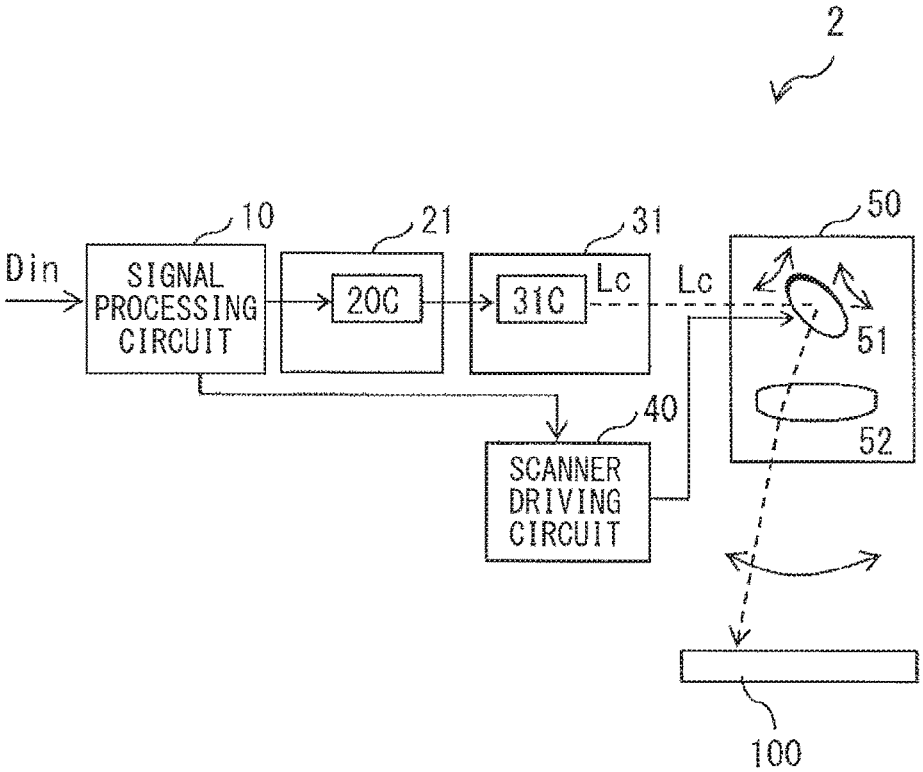

[ FIG. 7 ]
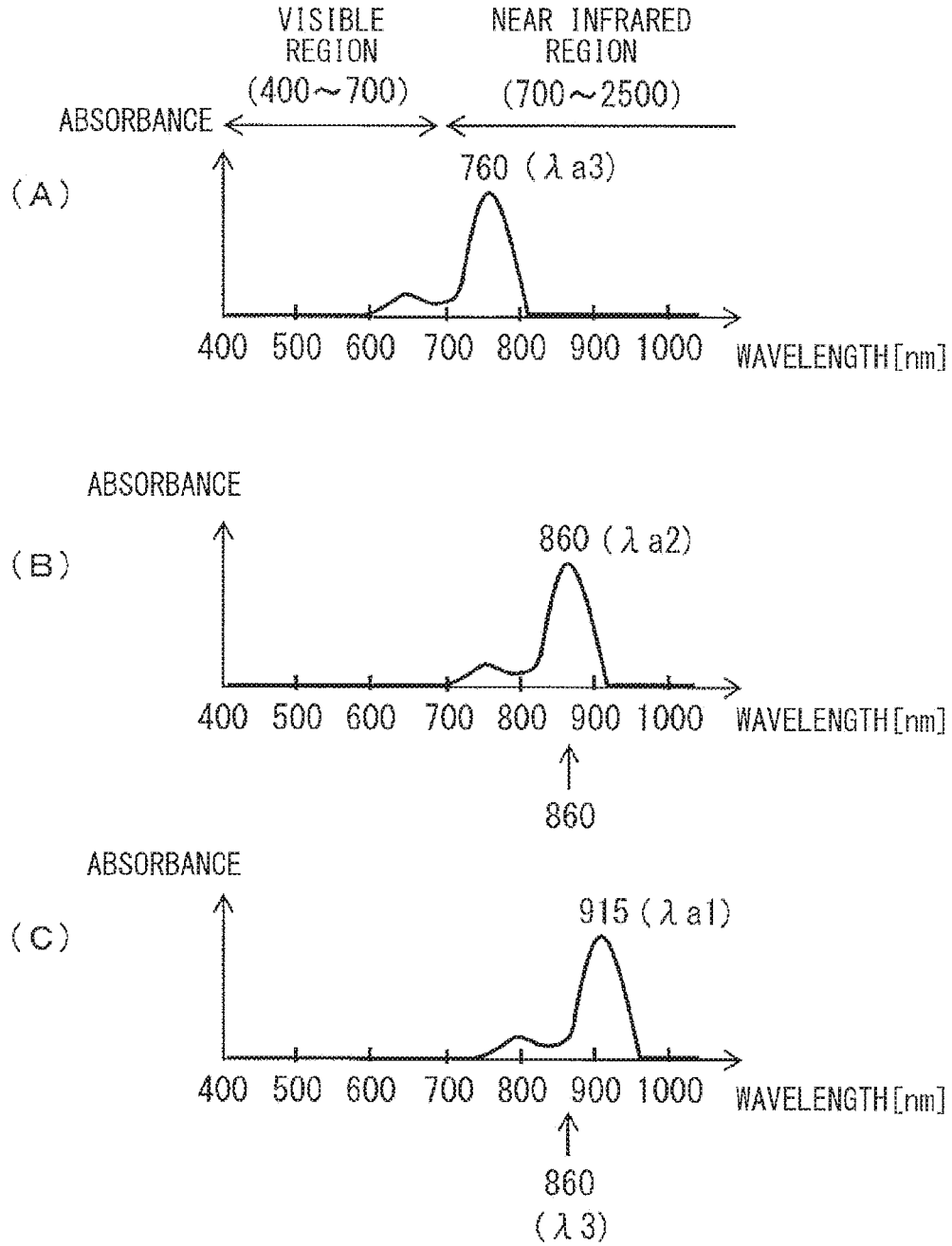

[ FIG. 8 ]
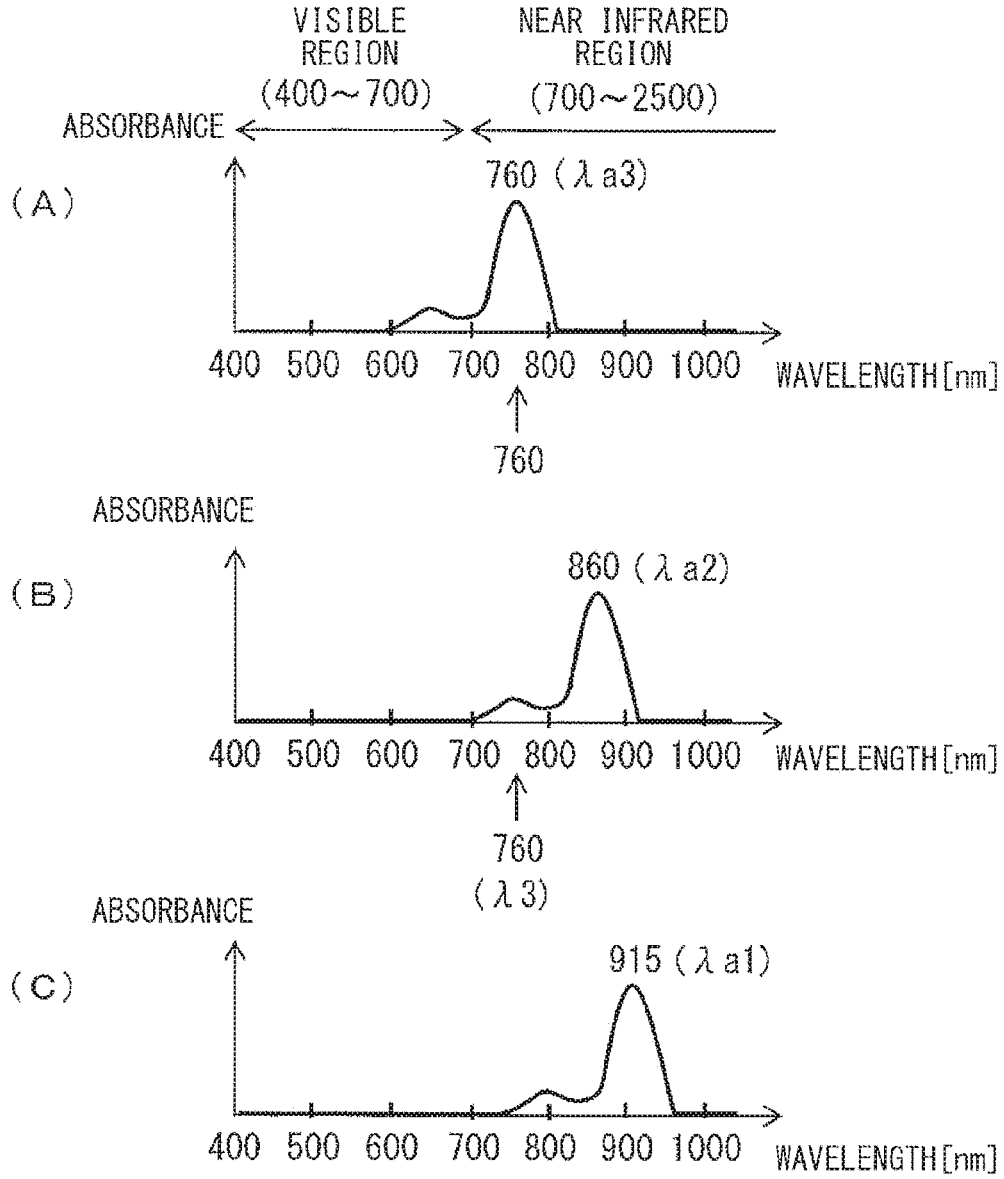

[ FIG. 9 ]
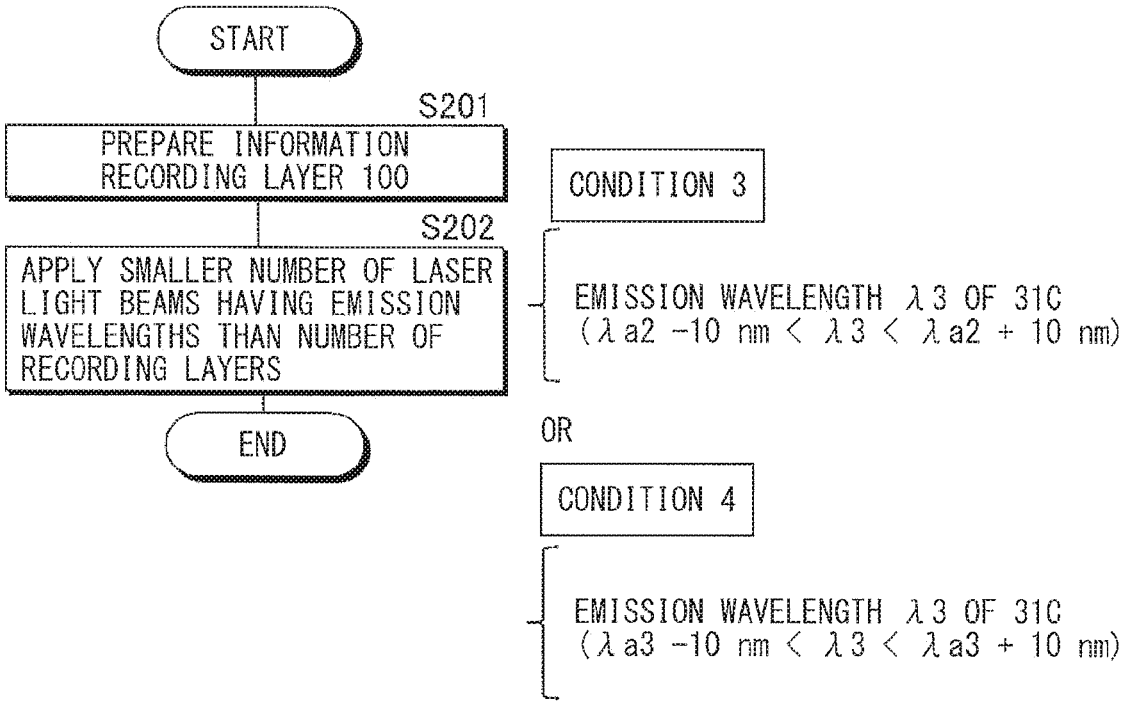
[ FIG. 10 ]
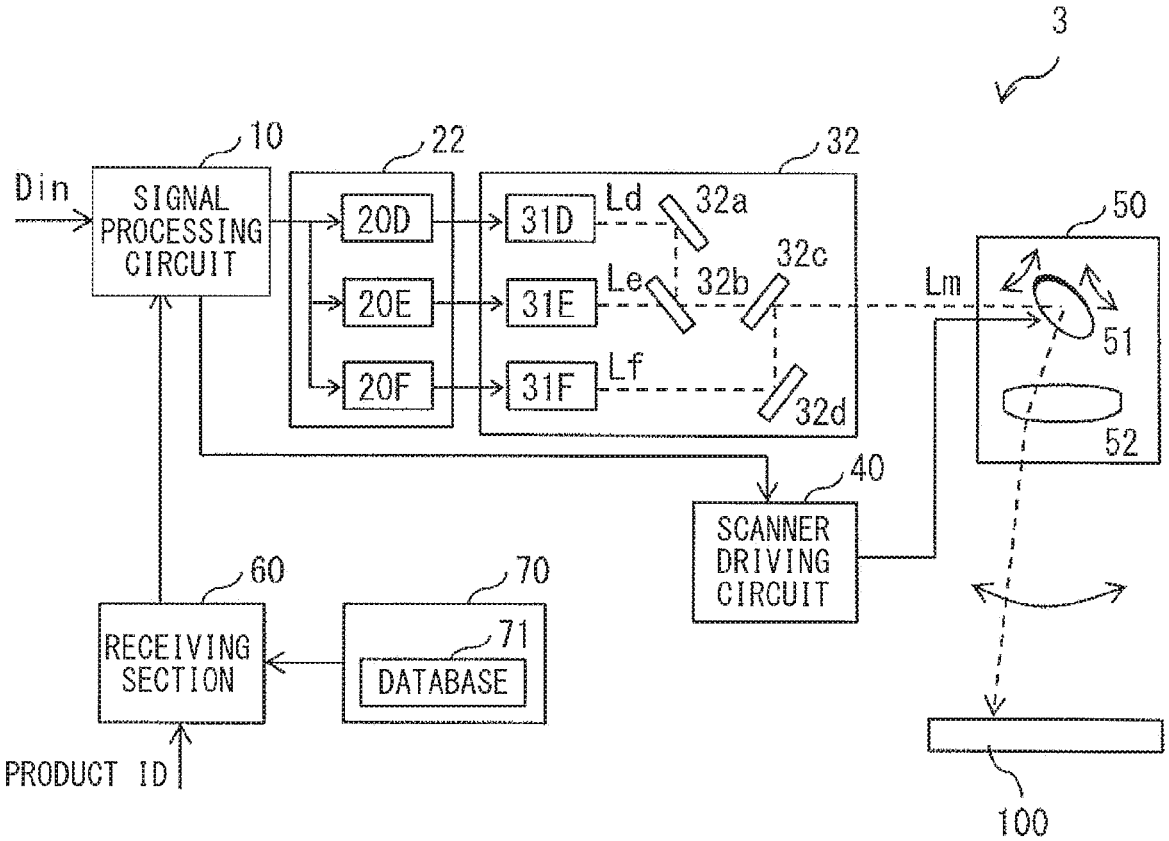

[ FIG. 11 ]
71A 71B 71
| PRODUCT ID | LASER ID | |
|---|---|---|
| 001 | 790 | 880 |
| 002 | 790 | 915 |
[ FIG. 12 ]
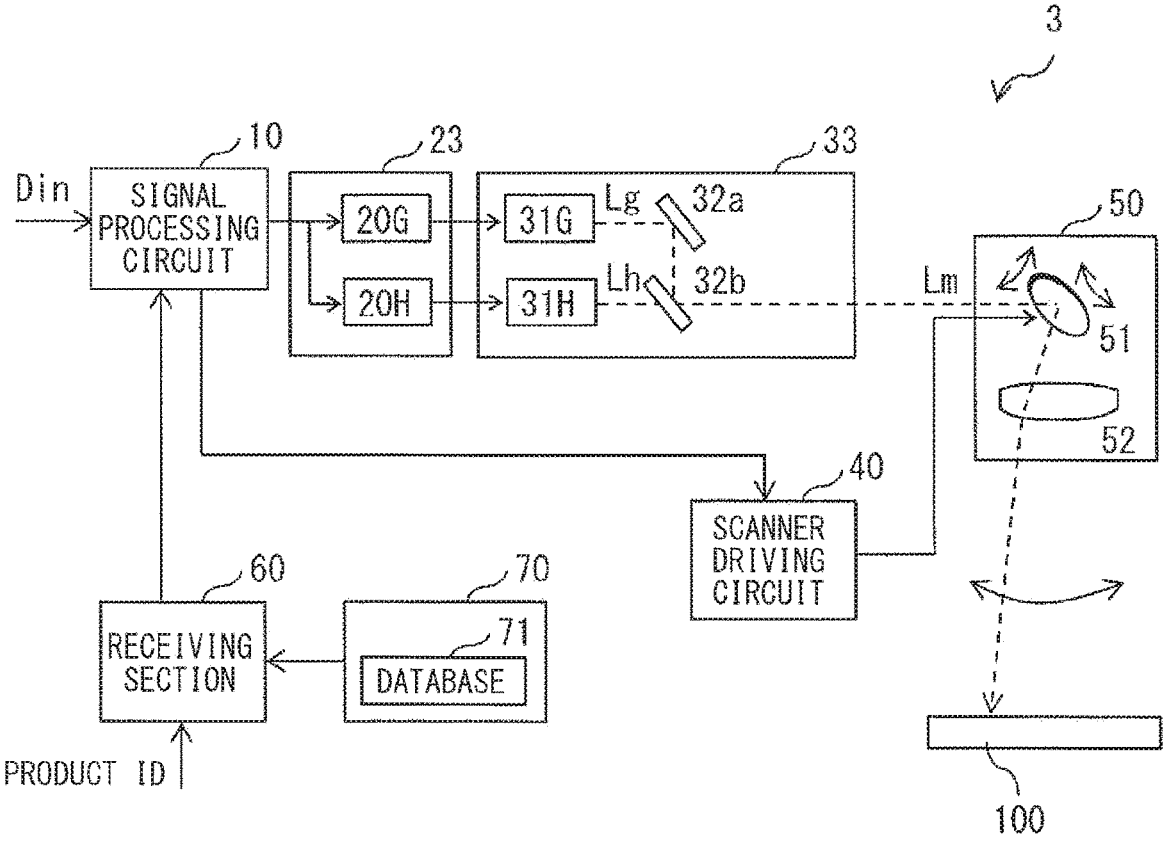
[ FIG. 13 ]
71A 71B 71
| PRODUCT ID | LASER ID |
|---|---|
| 003 | 860 |
| 004 | 760 |

ERASING UNIT AND ERASING METHOD

TECHNICAL FIELD

The present disclosure relates to an erasing unit and an erasing method.

BACKGROUND ART

Thermal recording media using a heat-sensitive color developing composition such as leuco dye have been in widespread use (see, for example, PTLs 1 to 3). Such recording media include an irreversible recording medium that does not allow for erasing of information once written thereon and a reversible recording medium that allows for rewriting of information any number of times, which are in practical use now. For example, information is written on and erased from a reversible recording medium by a drawing unit including a light source for writing and a light source for erasing. Furthermore, for example, information is written on a reversible recording medium by a writing unit including a light source for writing, and information is erased from the reversible recording medium by an erasing unit including a light source for erasing.

CITATION LIST

Patent Literature

PTL 1: Japanese Unexamined Patent Application Publication No. 2004-74584

PTL 2: Japanese Unexamined Patent Application Publication No. 2004-188827

PTL 3: Japanese Unexamined Patent Application Publication No. 2011-104995

SUMMARY OF THE INVENTION

Incidentally, it is desired for the drawing unit and the erasing unit described above to have a miniaturized configuration used for erasing. Therefore, it is desirable to provide an erasing unit and an erasing method that enable miniaturization.

An erasing unit according to an embodiment of the present disclosure is a unit that performs erasing of information written on a reversible recording medium. Herein, in the reversible recording medium, recording layers and heat-insulating layers are alternately stacked. The recording layers each includes a reversible heat-sensitive color developing composition and a photothermal conversion agent. Furthermore, in the reversible recording medium, developing colors of the respective reversible heat-sensitive color developing compositions differ among the recording layers, and absorption wavelengths of the respective photothermal conversion agents differ among the recording layers. The erasing unit includes: a light source section including one or a plurality of laser devices; and a controller that controls the light source section to cause the light source section to emit a smaller number of laser light beams having emission wavelengths than the number of the recording layers included in the reversible recording medium.

An erasing method according to an embodiment of the present disclosure includes performing the following for a reversible recording medium. In the reversible recording medium, recording layers and heat-insulating layers are alternately stacked. The recording layers each includes a reversible heat-sensitive color developing composition and a photothermal conversion agent. In the reversible recording medium, developing colors of the respective reversible heat-sensitive color developing compositions differ among the recording layers, and absorption wavelengths of the respective photothermal conversion agents differ among the recording layers.

The erasing method includes performing erasing of information written on the reversible recording medium by applying, to the reversible recording medium, a smaller number of laser light beams having emission wavelengths than the number of the recording layers included in the reversible recording medium.

In the erasing unit and the erasing method according to the embodiments of the present disclosure, a smaller number of laser light beams having emission wavelengths than the number of the recording layers included in the reversible recording medium are applied to the reversible recording medium. Accordingly, it is possible to reduce the size of the unit by a reduction in the number of laser devices as compared with a case where the unit is provided with as many laser devices as the number of the recording layers included in the reversible recording medium.

According to the erasing unit and the erasing method of the embodiments of the present disclosure, a smaller number of laser light beams having emission wavelengths than the number of the recording layers included in the reversible recording medium are applied to the reversible recording medium; therefore, it is possible to miniaturize the unit. It is to be noted that the effects of the present disclosure are not necessarily limited to those described here, and may be any of effects described in this specification.

BRIEF DESCRIPTION OF DRAWINGS

FIG. 1 is a diagram illustrating a system configuration example of an erasing unit according to a first embodiment of the present disclosure.

FIG. 2 is a diagram illustrating a cross-sectional configuration example of a reversible recording medium.

FIG. 3 is a diagram illustrating an example of a relationship between an absorption wavelength of each recording layer included in the reversible recording medium and an oscillation wavelength (an emission wavelength) of a laser light beam.

FIG. 4 is a diagram illustrating another example of the relationship between the absorption wavelength of each recording layer included in the reversible recording medium and the oscillation wavelength (the emission wavelength) of the laser light beam.

FIG. 5 is a diagram illustrating an example of a procedure of applying a laser light beam to the reversible recording medium.

FIG. 6 is a diagram illustrating a system configuration example of an erasing unit according to a second embodiment of the present disclosure.

FIG. 7 is a diagram illustrating an example of a relationship between an absorption wavelength of each recording layer included in the reversible recording medium and an oscillation wavelength (an emission wavelength) of a laser light beam.

FIG. 8 is a diagram illustrating another example of the relationship between the absorption wavelength of each recording layer included in the reversible recording medium and the oscillation wavelength (the emission wavelength) of the laser light beam.

FIG. 9 is a diagram illustrating an example of a procedure of applying a laser light beam to the reversible recording medium.

FIG. 10 is a diagram illustrating a system configuration example of an erasing unit according to a third embodiment of the present disclosure.

FIG. 11 is a diagram illustrating an example of a database illustrated in FIG. 10.

FIG. 12 is a diagram illustrating a modification example of a schematic configuration of the erasing unit illustrated in FIG. 10.

FIG. 13 is a diagram illustrating an example of a database illustrated in FIG. 12.

MODES FOR CARRYING OUT THE INVENTION

In the following, some embodiments of the present disclosure are described in detail with reference to the drawings. The following description is a specific example of the present disclosure, and the present disclosure is not limited to the aspects described below. It is to be noted that description is given in the following order.

1. First Embodiment
2. Second Embodiment
3. Third Embodiment
4. Modification Example of Third Embodiment

1. First Embodiment

[Configuration]

An erasing unit 1 according to a first embodiment of the present disclosure is described. FIG. 1 illustrates a system configuration example of the erasing unit 1 according to the present embodiment. The erasing unit 1 performs erasing of information written on a reversible recording medium 100. First, the reversible recording medium 100 is described, and then the erasing unit 1 is described.

(Reversible Recording Medium 100)

FIG. 2 illustrates a configuration example of respective layers included in the reversible recording medium 100. The reversible recording medium 100 has, for example, a structure in which recording layers 113 and heat-insulating layers 114 are alternately stacked on a base material 110.

The reversible recording medium 100 includes, for example, an underlayer 112, three recording layers 113 (113*a*, 113*b*, and 113*c*), two heat-insulating layers 114 (114*a* and 114*b*), and a protective layer 115 on the base material 110. The three recording layers 13 (113*a*, 113*b*, and 113*c*) are disposed in the order of the recording layer 113*a*, the recording layer 113*b*, and the recording layer 113*c* from side of the base material 110. The two heat-insulating layers 114 (114*a* and 114*b*) are disposed in the order of the heat-insulating layer 114*a* and the heat-insulating layer 114*b* from the side of the base material 110. The underlayer 112 is formed in contact with a surface of the base material 110. The protective layer 115 is formed on an outermost surface of the reversible recording medium 100.

The base material 110 supports the respective recording layers 113 and the respective heat-insulating layers 114. The base material 110 serves as a substrate for layers to be formed on its surface. The base material 110 may be one that allows light to pass therethrough, or may be one that does not allow light to pass therethrough. In a case where the base material 110 is the one that does not allow light to pass therethrough, a surface color of the base material 110 may be, for example, white, or may be a color other than white. The base material 110 includes, for example, ABS resin. The underlayer 112 has a function of improving adhesion between the recording layer 113*a* and the base material 110. The underlayer 112 includes, for example, a material that allows light to pass therethrough.

The three recording layers 113 (113*a*, 113*b*, and 113*c*) are able to reversibly change their state between a colored state and a decolored state. The three recording layers 113 (113*a*, 113*b*, and 113*c*) are configured to exhibit different colors from one another in the colored state. The three recording layers 113 (113*a*, 113*b*, and 113*c*) each include a leuco dye 100A (a reversible heat-sensitive color developing composition) and a photothermal conversion agent 100B (a first photothermal converting agent) that is caused to generate heat upon writing of information. The three recording layers 13 (113*a*, 113*b*, and 113*c*) each further include a developer and a polymer.

Heat causes the leuco dye 100A to be combined with the developer and put into a colored state, or to be separated from the developer and put into a decolored state. A developing color of the leuco dye 100A included in each recording layer 113 differs among the recording layers 113 (113*a*, 113*b*, and 113*c*). Heat causes the leuco dye 100A included in the recording layer 113*a* to be combined with the developer, thereby developing magenta color. Heat causes the leuco dye 100A included in the recording layer 113*b* to be combined with the developer, thereby developing cyan color. Heat causes the leuco dye 100A included in the recording layer 113*c* to be combined with the developer, thereby developing yellow color. A positional relationship among the three recording layers 113 (113*a*, 113*b*, and 113*c*) is not limited to the above-described example. Furthermore, the three recording layers 113 (113*a*, 113*b*, and 113*c*) become transparent in the decolored state. Accordingly, the reversible recording medium 100 allows for recording of an image using a wide gamut of colors.

The photothermal conversion agent 100B absorbs light in a near infrared region (700 nm to 2,500 nm) and generates heat. The respective photothermal conversion agents 100B included in the recording layers 113 (113*a*, 113*b*, and 113*c*) differ in absorption wavelength from one another. FIGS. 3 and 4 illustrate an example of absorption wavelengths of the photothermal conversion agents 100B included in the respective recording layers 113 (113*a*, 113*b*, and 113*c*). The photothermal conversion agent 100B included in the recording layer 113*c* has an absorption peak, for example, at 760 nm as illustrated in part (A) of FIG. 3 and part (A) of FIG. 4. The photothermal conversion agent 110B included in the recording layer 113*b* has an absorption peak, for example, at 860 nm as illustrated in part (B) of FIG. 3 and part (B) of FIG. 4. The photothermal conversion agent 100B included in the recording layer 113*a* has an absorption peak, for example, at 915 nm as illustrated in part (C) of FIG. 3 and part (C) of FIG. 4. The absorption peaks of the photothermal conversion agents 100B included in the respective recording layers 113 (113*a*, 113*b*, and 113*c*) are not limited to the above-described examples.

The heat-insulating layer 114*a* is for making heat transfer between the recording layer 113*a* and the recording layer 113*b* difficult. The heat-insulating layer 114*b* is for making heat transfer between the recording layer 113*b* and the recording layer 113*c* difficult. The protective layer 115 is for protecting a surface of the reversible recording medium 100, and serves as an overcoat layer of the reversible recording medium 100. The two heat-insulating layers 114 (114*a* and 114*b*) and the protective layer 115 include a transparent material. The reversible recording medium 100 may include, for example, a resin layer having relatively high rigidity (for example, a PEN resin layer) or the like directly underneath the protective layer 115.

[Manufacturing Method]

Subsequently, a specific method of manufacturing some of the layers in the reversible recording medium 100 is described.

A paint containing materials described below is dispersed for two hours by means of a rocking mill. The paint thereby obtained is applied with a wire bar, and is dried by heating at 70° C. for five minutes. Thus, the recording layer 13 having a thickness of 3 μm is formed.

A paint for forming the recording layer 113*a* contains the following materials.

Leuco dye (2 parts by weight)

[Chem. 1]

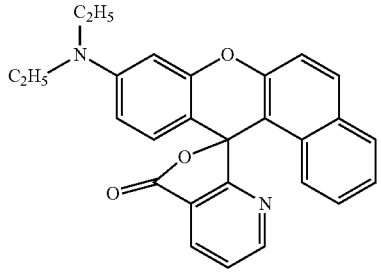

Color developer/reducer (4 parts by weight)

[Chem. 2]

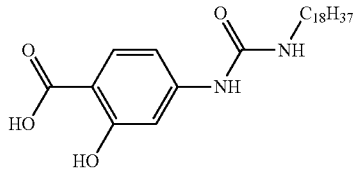

Vinyl chloride-vinyl acetate copolymer (5 parts by weight)

vinyl chloride: 90%, vinyl acetate: 10%, mean molecular weight (M.W.): 115000

Methyl ethyl ketone (MEK) (91 parts by weight)

Photothermal conversion agent cyanine-based infrared absorbing dye: 0.19 parts by weight (SDA7775 available from H. W. SANDS Corp., Absorption wavelength peak: 933 nm)

A paint for forming the recording layer 113*b* contains the following materials.

Leuco dye (1.8 parts by weight)

[Chem. 3]

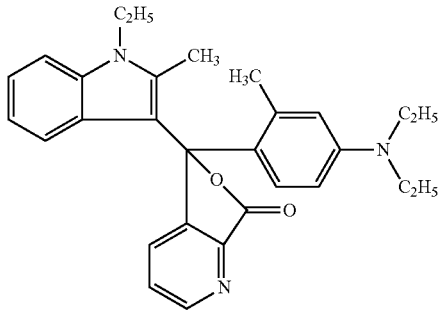

Color developer/reducer (4 parts by weight)

[Chem. 4]

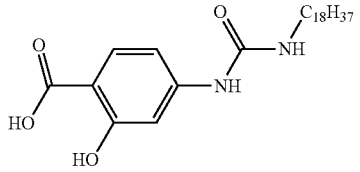

Vinyl chloride-vinyl acetate copolymer (5 parts by weight)

vinyl chloride: 90%, vinyl acetate: 10%, mean molecular weight (M.W.): 115000

Methyl ethyl ketone (MEK) (91 parts by weight)

Photothermal conversion agent cyanine-based infrared absorbing dye: 0.12 parts by weight (SDA5688 available from H. W. SANDS Corp., Absorption wavelength peak: 861 nm)

A paint for forming the recording layer 113*c* contains the following materials.

Leuco dye 100A (1.3 parts by weight)

[Chem. 5]

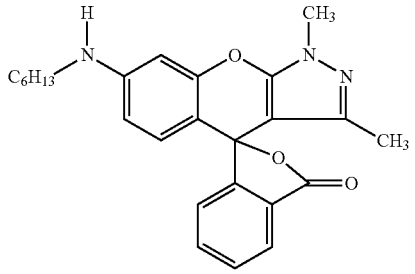

Color developer/reducer (4 parts by weight)

[Chem. 6]

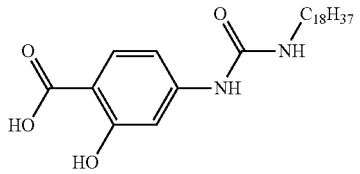

Vinyl chloride-vinyl acetate copolymer (5 parts by weight)

vinyl chloride: 90%, vinyl acetate: 10%, mean molecular weight (M.W.): 115000

Methyl ethyl ketone (MEK) (91 parts by weight)

Photothermal conversion agent cyanine-based infrared absorbing dye: 0.10 parts by weight (CY-10 available from Nippon Kayaku Co., Ltd., Absorption wavelength peak: 798 nm)

A polyvinyl alcohol solution is applied and dried. Thus, the heat-insulating layer 114 having a thickness of 20 μm is formed. Furthermore, ultraviolet curable resin is applied, and then is irradiated with ultraviolet light and cured. Thus, the protective layer 115 having a thickness of about 2 μm is formed.

(Erasing Unit 1)

Subsequently, the erasing unit 1 according to the present embodiment is described.

The erasing unit 1 includes a signal processing circuit 10 (a controller), a laser driving circuit 20, a light source section 30, a scanner driving circuit 40, and a scanner section 50.

For example, along with the laser driving circuit 20, the signal processing circuit 10 controls a rest value of current pulses applied to the light source section 30 (for example, light sources 31A and 31B to be described later), etc. in accordance with a characteristic of the reversible recording medium 100 and a condition written on the reversible recording medium 100. The signal processing circuit 10, for example, generates an image signal (an image signal for erasing) corresponding to properties, such as a wavelength, of a laser light beam from an erasing signal Din inputted from outside in synchronization with a scanning operation of the scanner section 50.

The signal processing circuit 10, for example, converts the inputted erasing signal Din into an image signal corresponding to a wavelength of each light source of the light source section 30 (color gamut conversion). The signal processing circuit 10, for example, generates a projection image clock signal synchronized with the scanning operation of the scanner section 50. The signal processing circuit 10, for example, generates a projection image signal (a projection image signal for erasing) that causes a laser light beam to be emitted in accordance with the generated image signal. The signal processing circuit 10, for example, outputs the generated projection image signal to the laser driving circuit 20. Furthermore, the signal processing circuit 10, for example, outputs the projection image clock signal to the laser driving circuit 20 as needed. The term "as needed" here is, for example, in a case where the projection image clock signal is used upon synchronizing a signal source of a high frequency signal with the image signal as will be described later.

The laser driving circuit 20, for example, drives the respective light sources 31A and 31B of the light source section 30 in accordance with projection image signals corresponding to respective wavelengths. The laser driving circuit 20, for example, controls luminance (brightness) of a laser light beam to draw an image (an image for erasing) corresponding to the projection image signals. The laser driving circuit 20 includes, for example, a driving circuit 20A that drives the light source 31A and a driving circuit 20B that drives the light source 31B. The light sources 31A and 31B emit laser light beams in the near infrared region (700 nm to 2,500 nm). The light source 31A is, for example, a semiconductor laser that emits a laser light beam La having an emission wavelength λ1. The light source 31B is, for example, a semiconductor laser that emits a laser light beam Lb having an emission wavelength λ2. The emission wavelengths λ1 and λ2 satisfy, for example, the following Condition 1 (Expressions (1) and (2)). The emission wavelengths λ1 and λ2 may satisfy, for example, the following Condition 2 (Expressions (3) and (4)).

Condition 1

$$\lambda a2<\lambda 1<\lambda a1 \ldots \quad (1)$$

$$\lambda a3<\lambda 2<\lambda a2 \ldots \quad (2)$$

Condition 2

$$\lambda a1-10\text{ nm}<\lambda 1<\lambda a1+10\text{ nm} \ldots \quad (3)$$

$$\lambda a3<\lambda 2<\lambda a2 \ldots \quad (4)$$

Here, λa1 denotes an absorption wavelength (an absorption peak wavelength) of a recording layer 120 to be described later, and is, for example, 915 nm. λa2 denotes an absorption wavelength (an absorption peak wavelength) of a recording layer 140 to be described later, and is, for example, 860 nm. λa3 denotes an absorption wavelength (an absorption peak wavelength) of a recording layer 160 to be described later, and is, for example, 760 nm. It is to be noted that "±10 nm" in Expression (3) means allowance limits of error. In a case where the emission wavelengths λ1 and λ2 satisfy the above-described Condition 1, the emission wavelength λ1 is, for example, 880 nm, and the emission wavelength λ2 is, for example, 790 nm. In a case where the emission wavelengths λ1 and λ2 satisfy the above-described Condition 2, the emission wavelength λ1 is, for example, 950 nm, and the emission wavelength λ2 is, for example, 790 nm.

The light source section 30 includes a smaller number of (for example, two) light sources than the number of (for example, three) recording layers 113 included in the reversible recording medium 100. The light source section 30 includes, for example, the two light sources 31A and 31B. The light source section 30 further includes, for example, one reflection mirror 32*a* and one dichroic mirror 32*b*. For example, each of the laser light beam La and the laser light beam Lb emitted from the two light sources 31A and 31B is converted into substantially parallel light (collimated light) by a collimating lens. Thereafter, for example, the laser light beam La is reflected by the reflection mirror 32*a* and further reflected by the dichroic mirror 32*b*, and the laser light beam Lb passes through the dichroic mirror 32*b*, and thus the laser light beam La and the laser light beam Lb are multiplexed together. The light source section 30, for example, outputs multiplexed light Lm obtained by multiplexing to the scanner section 50.

The scanner driving circuit 40, for example, drives the scanner section 50 in synchronization with the projection image clock signal inputted from the signal processing circuit 10. Furthermore, for example, in a case where a signal of an irradiation angle of a later-described two-axis scanner 51 or the like is inputted from the scanner section 50, the scanner driving circuit 40 drives the scanner section 50 to cause the irradiation angle to be a desired irradiation angle on the basis of the signal.

The scanner section 50, for example, line-sequentially scans the surface of the reversible recording medium 100 with the multiplexed light Lm outputted from the light source section 30. The scanner section 50 includes, for example, the two-axis scanner 51 and an fθ lens 52. The two-axis scanner 51 is, for example, a galvanometer mirror. The fθ lens 52 converts a uniform rotary motion made by the two-axis scanner 51 into a uniform linear motion of a spot moving on a focal plane (the surface of the reversible recording medium 100).

Subsequently, writing/erasing of information on/from the reversible recording medium 100 is described.

[Writing]

First, the reversible recording medium 100 is prepared, and is set in a writing unit. Next, for example, multiplexed light obtained by multiplexing a laser light beam having an emission wavelength of 760 nm, a laser light beam having an emission wavelength of 860 nm, and a laser light beam having an emission wavelength of 915 nm together is applied from the writing unit to the reversible recording medium 100. As a result, the laser light beam having an emission wavelength of 760 nm is absorbed by the photothermal conversion agent 100B in the recording layer 113*c*, thus the leuco dye 100A in the recording layer 113*c* reaches its writing temperature by heat generated from the photothermal conversion agent 100B, and is combined with the developer and develops yellow color. Yellow-color optical density depends on intensity of the laser light beam having an emission wavelength of 760 nm. Furthermore, the laser light beam having an emission wavelength of 860 nm is absorbed by the photothermal conversion agent 100B in the recording layer 113*b*, thus the leuco dye 100A in the recording layer 113*b* reaches its writing temperature by heat generated from the photothermal conversion agent 100B, and is combined with the developer and develops cyan color. Cyan-color optical density depends on intensity of the laser light beam having an emission wavelength of 860 nm. Moreover, the laser light beam having an emission wavelength of 915 nm is absorbed by the photothermal conversion agent 100B in the recording layer 113*a*, thus the leuco dye 100A in the recording layer 113*a* reaches its writing temperature by heat generated from the photothermal conversion agent 100B, and is combined with the developer and develops magenta color. Magenta-color optical density depends on intensity of the laser light beam having an emission wavelength of 915 nm. As a result, a desired color is produced by a mixture of the yellow, cyan, and magenta colors. In this way, writing of information on the reversible recording medium 100 is performed.

[Erasing]

First, the reversible recording medium 100 with information written thereon as described above is prepared, and is set in the erasing unit 1 (step S101 in FIG. 5). Next, the erasing unit 1 (the signal processing circuit 10) controls the light source section 30 to cause the light source section 30 to apply a smaller number (for example, two) of laser light beams having emission wavelengths than the number (for example, three) of recording layers 113 included in the set reversible recording medium 100 to the reversible recording medium 100 (step S102 in FIG. 5). That is, upon applying laser light beams to the reversible recording medium 100, the erasing unit 1 (the signal processing circuit 10) uses the laser light beam La of which an emission wavelength is $\lambda 1$ and the laser light beam Lb of which an emission wavelength is $\lambda 2$.

Here, assume that the wavelengths $\lambda 1$ and $\lambda 2$ satisfy the above-described Condition 1 (Expressions (1) and (2)). In this case, the laser light beam La having the emission wavelength $\lambda 1$ (for example, 880 nm) is absorbed by, for example, photothermal conversion agents 100C in the recording layers 113*a* and 113*b*. Furthermore, the laser light beam Lb having the emission wavelength $\lambda 2$ (for example, 790 nm) is absorbed by, for example, the photothermal conversion agent 100C in the recording layer 113*c*. Thus, the leuco dyes 100A in the respective recording layers 113 reach their erasing temperature by heat generated from the photothermal conversion agents 100C in the recording layers 113*a*, 113*b*, and 113*c*, and are each separated from the developer and decolored. In this way, the erasing unit 1 performs erasing of information written on the reversible recording medium 100.

Meanwhile, assume that the wavelengths $\lambda 1$ and $\lambda 2$ satisfy the above-described Condition 2 (Expressions (3) and (4)). In this case, the laser light beam La having the emission wavelength $\lambda 1$ (for example, 915 nm) is absorbed by, for example, the respective photothermal conversion agents 100C in the recording layers 113*a* and 113*b*. Furthermore, the laser light beam Lb having the emission wavelength $\lambda 2$ (for example, 790 nm) is absorbed by, for example, the photothermal conversion agent 100C in the recording layer 113*c*. Thus, the leuco dyes 100A in the respective recording layers 113 reach their erasing temperature by heat generated from the photothermal conversion agents 100C in the recording layers 113*a*, 113*b*, and 113*c*, and are each separated from the developer and decolored. In this way, the erasing unit 1 performs erasing of information written on the reversible recording medium 100.

[Effects]

Subsequently, effects of the erasing unit 1 according to the present embodiment are described.

Thermal recording media using a heat-sensitive color developing composition such as leuco dye have been in widespread use. Such recording media include an irreversible recording medium that does not allow for erasing of information once written thereon and a reversible recording medium that allows for rewriting of information any number of times, which are in practical use now. For example, information is written on and erased from a reversible recording medium by a drawing unit including a light source for writing and a light source for erasing. Furthermore, for example, information is written on a reversible recording medium by a writing unit including a light source for writing, and information is erased from the reversible recording medium by an erasing unit including a light source for erasing. Incidentally, it is desired for the drawing unit and the erasing unit described above to have a miniaturized configuration used for erasing.

Meanwhile, in the present embodiment, a smaller number of laser light beams having emission wavelengths than the number of the recording layers 13 included in the reversible recording medium 100 are applied to the reversible recording medium 100. Accordingly, it is possible to reduce the size of the unit by a reduction in the number of laser devices as compared with a case where the unit is provided with as many laser devices as the number of the recording layers 13 included in the reversible recording medium 100. As a result, it is possible to miniaturize the unit.

Furthermore, in the present embodiment, in an erasing operation, the laser light beam La of which the emission wavelength is $\lambda 1$ and the laser light beam Lb of which the emission wavelength is $\lambda 2$ are used upon applying laser light beams to the reversible recording medium 100. Accordingly, as the number of laser devices is smaller by one than the number of the recording layers 13, it is possible to reduce the size of the unit by one laser device as compared with a case where the unit is provided with as many (for example, three) laser devices as the number of the recording layers 13 included in the reversible recording medium 100. As a result, it is possible to miniaturize the unit.

2. Second Embodiment

[Configuration]

Subsequently, an erasing unit 2 according to a second embodiment of the present disclosure is described. FIG. 6 illustrates a system configuration example of the erasing unit 2 according to the present embodiment. The erasing unit 2 performs erasing of information written on the reversible recording medium 100.

(Erasing Unit 2)

The erasing unit 2 includes the signal processing circuit 10 (the controller), a laser driving circuit 21, a light source section 31, the scanner driving circuit 40, and the scanner section 50.

The laser driving circuit 21, for example, drives the light source section 31 (for example, a light source 31C to be described later) in accordance with a projection image signal (a projection image signal for erasing) corresponding to a wavelength of the light source section 31. The laser driving circuit 21, for example, controls luminance (brightness) of a laser light beam to draw an image (an image for erasing) corresponding to the projection image signal. The laser driving circuit 21 includes, for example, a driving circuit 20C that drives the light source 31C. The light source 31C emits a laser light beam in the near infrared region (700 nm to 2,500 nm). The light source 31C is, for example, a semiconductor laser that emits a laser light beam Lc having an emission wavelength λ3. The emission wavelength λ3 satisfies, for example, the following Condition 3 (Expression (5)). The emission wavelength λ3 may fulfill, for example, the following Condition 4 (Expression (6)).

Condition 3

$$\lambda a2-10\text{ nm}<\lambda 3<\lambda a2+10\text{ nm} \ldots \quad (5)$$

Condition 4

$$\lambda a3-10\text{ nm}<\lambda 4<\lambda a3+10\text{ nm} \ldots \quad (6)$$

In Expressions (5) and (6), "±10 nm" means allowance limits of error. In a case where the emission wavelength λ3 satisfies the above-described Condition 3, the emission wavelength λ3 is, for example, 860 nm. In a case where the emission wavelength λ3 satisfies the above-described Condition 4, the emission wavelength λ3 is, for example, 760 nm.

The light source section 31 includes a smaller number (for example, one) of light sources than the number of (for example, three) recording layers 113 included in the reversible recording medium 100. The light source section 31 includes, for example, the one light source 31C. For example, a laser light beam L3 emitted from the light source 31C is converted into substantially parallel light (collimated light) by a collimating lens. The light source section 31, for example, outputs the laser light beam Lc from the light source 31C to the scanner section 50. The scanner section 50, for example, line-sequentially scans the surface of the reversible recording medium 100 with the laser light beam Lc outputted from the light source section 31.

Subsequently, erasing of information from the reversible recording medium 100 is described. It is to be noted that a method of writing information on the reversible recording medium 100 is similar to the writing method described in the foregoing embodiment.

[Erasing]

First, the reversible recording medium 100 with information written thereon is prepared, and is set in the erasing unit 2 (step S201 in FIG. 9). Next, the erasing unit 2 (the signal processing circuit 10) controls the light source section 31 to cause the light source section 31 to apply a smaller number (for example, one) of laser light beams having emission wavelengths than the number (for example, three) of recording layers 113 included in the set reversible recording medium 100 to the reversible recording medium 100 (Step S202 in FIG. 9). That is, upon applying a laser light beam to the reversible recording medium 100, the erasing unit 2 (the signal processing circuit 10) uses the laser light beam L3 of which an emission wavelength is λ3.

Here, assume that the wavelength λ3 satisfies the above-described Condition 3 (Expression (5)). In this case, the laser light beam L3 having the emission wavelength λ3 (for example, 860 nm) is absorbed by, for example, the photothermal conversion agents 100C in the recording layers 113*b* and 113*c*. Thus, the leuco dyes 100A in the respective recording layers 113 reach their erasing temperature by heat generated from the photothermal conversion agents 100C in the recording layers 113*b* and 113*c*, and are each separated from the developer and decolored. In this way, the erasing unit 2 performs erasing of information written on the reversible recording medium 100.

Meanwhile, assume that the wavelength λ3 satisfies the above-described Condition 4 (Expression (6)). In this case, the laser light beam L3 having the emission wavelength λ3 (for example, 760 nm) is absorbed by, for example, the photothermal conversion agents 100C in the recording layers 113*a* and 113*b*. Thus, the leuco dyes 100A in the respective recording layers 113 reach their erasing temperature by heat generated from the photothermal conversion agents 100C in the recording layers 113*a* and 113*b*, and are each separated from the developer and decolored. In this way, the erasing unit 2 performs erasing of information written on the reversible recording medium 100.

[Effects]

Subsequently, effects of the erasing unit 2 according to the present embodiment are described.

In the present embodiment, a smaller number of laser light beams having emission wavelengths than the number of the recording layers 13 included in the reversible recording medium 100 are applied to the reversible recording medium 100. Accordingly, it is possible to reduce the size of the unit by a reduction in the number of laser devices as compared with a case where the unit is provided with as many laser devices as the number of the recording layers 13 included in the reversible recording medium 100. As a result, it is possible to miniaturize the unit.

Furthermore, in the present embodiment, in an erasing operation, the laser light beam L3 of which the emission wavelength is λ3 is used upon applying a laser light beam to the reversible recording medium 100. Accordingly, as the number of laser devices is smaller by two than the number of the recording layers 13, it is possible to reduce the size of the unit by two laser devices as compared with a case where the unit is provided with as many (for example, three) laser devices as the number of the recording layers 13 included in the reversible recording medium 100. As a result, it is possible to miniaturize the unit.

3. Third Embodiment

[Configuration]

Subsequently, an erasing unit 3 according to a third embodiment of the present disclosure is described. FIG. 10 illustrates a system configuration example of the erasing unit 3 according to the present embodiment. The erasing unit 3 performs erasing of information written on the reversible recording medium 100.

(Erasing Unit 3)

The erasing unit 3 includes the signal processing circuit 10, a laser driving circuit 22, a light source section 32, the scanner driving circuit 40, and the scanner section 50. The erasing unit 3 further includes a receiving section 60 and a storage section 70. The signal processing circuit 10 and the receiving section 60 correspond to a specific example of the "controller" of the present disclosure.

As illustrated in FIGS. 10 and 11, the storage section 70, for example, stores an identifier (a first identifier) that identifies a type of the reversible recording medium 100 and an identifier (a second identifier) that identifies one or a plurality of light sources included in the light source section 32 that are associated with each other. For example, as illustrated in FIGS. 10 and 11, the storage section 70 includes a database 71 in which the first identifier and the second identifier are associated with each other. The database 71 stores, as the first identifier, a product ID 71A that identifies a type of the reversible recording medium 100 and, as the second identifier, a laser ID 71B that identifies a type of a light source corresponding to the reversible recording medium 100.

Here, assume that the light source 32 includes light sources that meet both Conditions 1 and 2 (Expressions (7) to (10)). At this time, the light source 32 includes, for example, light sources 31D, 31E, and 32F. The light source 31D is a semiconductor laser that emits a laser light beam Ld having an emission wavelength λ5. The light source 31E is a semiconductor laser that emits a laser light beam Le having an emission wavelength λ6. The light source 31D is a semiconductor laser that emits a laser light beam Lf having an emission wavelength λ7. The emission wavelengths λ5 and λ6 satisfy the following Condition 1 (Expressions (7) and (8)). The emission wavelengths λ6 and λ7 satisfy the following Condition 2 (Expressions (9) and (10)). The emission wavelength λ5 is, for example, 880 nm; the emission wavelength λ6 is, for example, 790 nm; and the emission wavelength λ7 is, for example, 915 nm.

Condition 1

$$\lambda a2<\lambda 5<\lambda a1 \ldots \quad (7)$$

$$\lambda a3<\lambda 6<\lambda a2 \ldots \quad (8)$$

Condition 2

$$\lambda a1-10\text{ nm}<\lambda 7<\lambda a1+10\text{ nm} \ldots \quad (9)$$

$$\lambda a3<\lambda 6<\lambda a2 \ldots \quad (10)$$

In a case where the light source 32 includes light sources that meet both Conditions 1 and 2 (Expressions (7) to (10)), the database 71 contains, for example, "001" assigned to the product ID 71A corresponding to Condition 1, and "880 (i.e., the light source 31D)" and "790 (i.e., the light source 31E)" assigned to the laser IDs 71B corresponding to Condition 1. Furthermore, the database 71 contains, for example, "002" assigned to the product ID 71A corresponding to Condition 2, and "915 (i.e., the light source 31F)" and "790 (i.e., the light source 31E)" assigned to the laser IDs 71B corresponding to Condition 2.

The receiving section 60 receives, for example, an input of the product ID 71A as an identifier that identifies a type of the reversible recording medium 100. Furthermore, the receiving section 60 reads out, from the database 71, the laser IDs 71B corresponding to the product ID 71A as identifiers that identify a light source for erasing of the reversible recording medium 100 corresponding to the product ID 71A. Moreover, the receiving section 60 outputs the laser IDs 71B read out from the database 71 to the signal processing circuit 10. The signal processing circuit 10 selects a plurality of light sources corresponding to the laser IDs 71B inputted from the receiving section 60, and controls the selected plurality of light sources through the laser driving circuit 22. At this time, the signal processing circuit 10 controls the light source section 32 to cause the light source section 32 to apply a smaller number (for example, two) of laser light beams having emission wavelengths than the number (for example, three) of recording layers 113 included in the reversible recording medium 100 corresponding to the product ID 71A to the reversible recording medium 100.

The laser driving circuit 22, for example, drives the light source section 32 in accordance with a projection image signal (a projection image signal for erasing) corresponding to each wavelength of the light source section 32. The laser driving circuit 22, for example, controls luminance (brightness) of a laser light beam to draw an image (an image for erasing) corresponding to the projection image signal. The laser driving circuit 22 includes, for example, a driving circuit 20D that drives the light source 31D, a driving circuit 20E that drives the light source 31E, and a driving circuit 20F that drives the light source 31F.

The light source section 32 includes, for example, two reflection mirrors 32*a* and 32*d* and two dichroic mirrors 32*b* and 32*c*.

For example, each of the laser light beams Ld and Le emitted from the two light sources 31D and 31E is converted into substantially parallel light (collimated light) by a collimating lens. Thereafter, for example, the laser light beam Ld is reflected by the reflection mirror 32*a* and further reflected by the dichroic mirror 32*b*, and the laser light beam Le passes through the dichroic mirror 32*b*, and thus the laser light beam Ld and the laser light beam Le are multiplexed together. The light source section 32, for example, outputs multiplexed light Lm obtained by multiplexing to the scanner section 50.

For example, the laser light beam Lf emitted from the light source 31F is converted into substantially parallel light (collimated light) by a collimating lens. Thereafter, for example, the laser light beam Lf is reflected by, for example, the reflection mirror 32*d* and further reflected by the dichroic mirror 32*c*. The light source section 32, for example, outputs the laser light beam Lf reflected by the dichroic mirror 32*c* to the scanner section 50.

Subsequently, erasing of information from the reversible recording medium 100 is described. It is to be noted that a method of writing information on the reversible recording medium 100 is similar to the writing method described in the foregoing embodiment.

[Erasing]

First, the reversible recording medium 100 with information written thereon is prepared, and is set in the erasing unit 3. Next, a user inputs a product ID to the receiving section 60. Then, the receiving section 60 receives the product ID from the user, and reads out the laser ID 71B associated with the received product ID from the storage section 70 (the database 71). The receiving section 60 outputs the laser ID 71B read out from the storage section 70 (the database 71) to the signal processing circuit 10. The signal processing circuit 10 selects a light source to be driven on the basis of the laser ID 71B inputted from the receiving section 60. The signal processing circuit 10 generates a projection image signal (a projection image signal for erasing) for driving the selected light source. The signal processing circuit 10 outputs the generated projection image signal to the laser driving circuit 20. At this time, the signal processing circuit 10 controls the light source section 31 to cause the light source section 31 to apply a smaller number (for example, two) of laser light beams having emission wavelengths than the number (for example, three) of recording layers 113 included in the set reversible recording medium 100 to the reversible recording medium 100.

Here, assume that the product ID inputted from the user is "001". At this time, the laser light beam Ld having the emission wavelength λ5 (for example, 880 nm) is absorbed by, for example, the photothermal conversion agents 100C in the recording layers 113*a* and 113*b*. Furthermore, the laser light beam Le having the emission wavelength λ6 (for example, 790 nm) is absorbed by, for example, the photothermal conversion agent 100C in the recording layer 113*c*. Thus, the leuco dyes 10A in the respective recording layers 113 reach their erasing temperature by heat generated from the photothermal conversion agents 100C in the recording layers 113*a*, 113*b*, and 113*c*, and are each separated from the developer and decolored. In this way, the erasing unit 3 performs erasing of information written on the reversible recording medium 100.

Meanwhile, assume that the product ID inputted from the user is "002". At this time, the laser light beam Lf having the emission wavelength λ7 (for example, 915 nm) is absorbed by, for example, the photothermal conversion agents 100C in the recording layers 113*a* and 113*b*. Furthermore, the laser light beam Le having the emission wavelength λ6 (for example, 790 nm) is absorbed by, for example, the photothermal conversion agent 100C in the recording layer 113*c*. Thus, the respective leuco dyes 10A in the recording layers 113 reach their erasing temperature by heat generated from the photothermal conversion agents 10C in the recording layers 113*a*, 113*b*, and 113*c*, and are each separated from the developer and decolored. In this way, the erasing unit 1 performs erasing of information written on the reversible recording medium 100.

In this way, in the present embodiment, it is possible to select two erasing methods for the reversible recording medium 100.

4. Modification Example of Third Embodiment

Subsequently, a modification example of the erasing unit 3 according to the third embodiment is described.

FIG. 12 illustrates a system configuration example of the erasing unit 3 according to the present modification example. In the present modification example, as illustrated in FIGS. 12 and 13, the storage section 70, for example, stores an identifier (a first identifier) that identifies a type of the reversible recording medium 100 and an identifier (a second identifier) that identifies one or a plurality of light sources included in a light source section 33 that are associated with each other. For example, as illustrated in FIGS. 12 and 13, the storage section 70 includes the database 71 in which the first identifier and the second identifier are associated with each other. The database 71 stores, as the first identifier, the product ID 71A that identifies a type of the reversible recording medium 100 and, as the second identifier, the laser ID 71B that identifies a type of a light source corresponding to the reversible recording medium 100.

Here, assume that the light source 33 includes light sources that meet both Conditions 3 and 4 (Expressions (5) and (6)). At this time, the light source 33 includes, for example, light sources 31G and 31H. The light source 31G is a semiconductor laser that emits laser light beam Lg having the emission wavelength λ3. The light source 31H is a semiconductor laser that emits laser light beam Lh having an emission wavelength λ4. The emission wavelength λ3 satisfies the following Condition 3 (Expression (5)). The emission wavelength λ4 satisfies the following Condition 4 (Expression (6)). The emission wavelength λ3 is, for example, 860 nm, and the emission wavelength λ4 is, for example, 760 nm.

Condition 3

$$\lambda a2-10\text{ nm}<\lambda 3<\lambda a2+10\text{ nm} \ldots \quad (5)$$

Condition 4

$$\lambda a3-10\text{ nm}<\lambda 4<\lambda a3+10\text{ nm} \ldots \quad (6)$$

In a case where the light source 33 includes light sources that meet both Conditions 3 and 4 (Expressions (5) and (6)), the database 71 contains, for example, "003" assigned to the product ID 71A corresponding to Condition 3 and "860 (i.e., the light source 31G)" assigned to the laser ID 71B corresponding to Condition 3. Furthermore, the database 71 contains, for example, "004" assigned to the product ID 71A corresponding to Condition 4 and "760 (i.e., the light source 31H)" assigned to the laser ID 71B corresponding to Condition 4.

The receiving section 60 receives, for example, an input of the product ID 71A as an identifier that identifies a type of the reversible recording medium 100. Furthermore, the receiving section 60 reads out, from the database 71, the laser ID 71B corresponding to the product ID 71A as an identifier that identifies a light source for erasing of the reversible recording medium 100 corresponding to the product ID 71A. Moreover, the receiving section 60 outputs the laser ID 71B read out from the database 71 to the signal processing circuit 10. The signal processing circuit 10 selects a plurality of light sources corresponding to the laser ID 71B inputted from the receiving section 60, and controls the selected plurality of light sources through the laser driving circuit 22. At this time, the signal processing circuit 10 controls the light source section 32 to cause the light source section 32 to apply a smaller number (for example, one) of laser light beams having emission wavelengths than the number (for example, three) of recording layers 113 included in the reversible recording medium 100 corresponding to the product ID 71A to the reversible recording medium 100.

The laser driving circuit 23, for example, drives the light source section 33 in accordance with a projection image signal (a projection image signal for erasing) corresponding to each wavelength of the light source section 33. The laser driving circuit 23, for example, controls luminance (brightness) of a laser light beam to draw an image (an image for erasing) corresponding to the projection image signal. The laser driving circuit 23 includes, for example, a driving circuit 20G that drives the light source 31G and a driving circuit 20H that drives the light source 31H.

The light source section 33 includes, for example, the one reflection mirror 32*a* and the one dichroic mirror 32*b*.

For example, the laser light beam Lg emitted from the light source 31G is converted into substantially parallel light (collimated light) by a collimating lens. Thereafter, for example, the laser light beam Lg is reflected by the reflection mirror 32*a* and further reflected by the dichroic mirror 32*b*. The light source section 33, for example, outputs the laser light beam Lg reflected by the dichroic mirror 32*c* to the scanner section 50.

For example, the laser light beam Lh emitted from the light source 31H is converted into substantially parallel light (collimated light) by a collimating lens. Then, for example, the laser light beam Lh passes through the dichroic mirror 32*b*. The light source section 32, for example, outputs the laser light beam Lh having passed through the dichroic mirror 32*c* to the scanner section 50.

Subsequently, erasing of information from the reversible recording medium 100 is described. It is to be noted that a method of writing information on the reversible recording medium 100 is similar to the writing method described in the foregoing embodiment.

[Erasing]

First, the reversible recording medium 100 with information written thereon is prepared, and is set in the erasing unit 3. Next, a user inputs a product ID to the receiving section 60. Then, the receiving section 60 receives the product ID from the user, and reads out the laser ID 71B associated with the received product ID from the storage section 70 (the database 71). The receiving section 60 outputs the laser ID 71B read out from the storage section 70 (the database 71) to the signal processing circuit 10. The signal processing circuit 10 selects a light source to be driven on the basis of the laser ID 71B inputted from the receiving section 60. The signal processing circuit 10 generates a projection image signal (a projection image signal for erasing) for driving the selected light source. The signal processing circuit 10 outputs the generated projection image signal to the laser driving circuit 20. At this time, the signal processing circuit 10 controls the light source section 31 to cause the light source section 31 to apply a smaller number (for example, one) of laser light beams having emission wavelengths than the number (for example, three) of recording layers 113 included in the set reversible recording medium 100 to the reversible recording medium 100.

Here, assume that the product ID inputted from the user is "003". At this time, the laser light beam Lg having the emission wavelength λ3 (for example, 860 nm) is absorbed by, for example, the photothermal conversion agents 100C in the recording layers 113*a* and 113*b*. Thus, the leuco dyes 10A in the respective recording layers 113 reach their erasing temperature by heat generated from the photothermal conversion agents 100C in the recording layers 113*a* and 113*b*, and are each separated from the developer and decolored. In this way, the erasing unit 3 performs erasing of information written on the reversible recording medium 100.

Meanwhile, assume that the product ID inputted from the user is "004". At this time, the laser light beam Lh having the emission wavelength λ4 (for example, 760 nm) is absorbed by, for example, the photothermal conversion agents 100C in the recording layers 113*b* and 113*c*. Thus, the leuco dyes 10A in the respective recording layers 113 reach their erasing temperature by heat generated from the photothermal conversion agents 10C in the recording layers 113*b* and 113*c*, and are each separated from the developer and decolored. In this way, the erasing unit 1 performs erasing of information written on the reversible recording medium 100.

In this way, even in the present modification example, it is possible to select two erasing methods for the reversible recording medium 100.

The present disclosure has been described above with reference to the embodiments and the modification example; however, the present disclosure is not limited to the above-described embodiments, etc., and may be modified in a variety of ways. It is to be noted that the effects described in this specification are merely exemplary. The effects of the present disclosure are not limited to the effects described in this specification. The present disclosure may have effects other than those described in this specification.

Furthermore, for example, the present disclosure may have the following configurations.

(1)

An erasing unit, the erasing unit that performs erasing of information written on a reversible recording medium, the reversible recording medium including recording layers and heat-insulating layers alternately stacked, the recording layers each including a reversible heat-sensitive color developing composition and a photothermal conversion agent, developing colors of the respective reversible heat-sensitive color developing compositions differing among the recording layers, absorption wavelengths of the respective photothermal conversion agents differing among the recording layers, the erasing unit including:

a light source section including one or a plurality of laser devices; and a controller that controls the light source section to cause the light source section to apply, to the reversible recording medium, a smaller number of laser light beams having emission wavelengths than a number of the recording layers included in the reversible recording medium.

(2)

The erasing unit according to (1), further including a receiving section that receives an input of a first identifier that identifies a type of the reversible recording medium, in which the controller controls the light source section to cause the light source section to apply, to the reversible recording medium, a smaller number of laser light beams having emission wavelengths than a number of the recording layers included in the reversible recording medium corresponding to the first identifier received by the receiving section.

(3)

The erasing unit according to (2), further including a storage section that stores the first identifier and a second identifier that identifies the one or plurality of laser devices included in the light source section, the first identifier and the second identifier being associated with each other, in which the controller reads out, from the storage section, the second identifier associated with the first identifier received by the receiving section, and drives, of the one or plurality of laser devices included in the light source section, one or a plurality of first laser devices corresponding to the second identifier read out from the storage section.

(4)

The erasing unit according to (3), in which the reversible recording medium corresponding to the first identifier received by the receiving section is provided with, as a plurality of the recording layers, a first recording layer of which an absorption wavelength is a wavelength λa1, a second recording layer of which an absorption wavelength is a wavelength λa2 (λa2<λa1), and a third recording layer of which an absorption wavelength is a wavelength λa3 (λa3<λa2), the light source section is provided with, as the plurality of laser devices, a first laser device of which an emission wavelength is λb1 (λa2<λb1<λa1) and a second laser device of which an emission wavelength is λb2 (λa3<λa2<λa2), and identifiers of the first laser device and the second laser device are stored as the second identifier in the storage section.

(5)

The erasing unit according to (3), in which the reversible recording medium corresponding to the first identifier received by the receiving section is provided with, as a plurality of the recording layers, a first recording layer of which an absorption wavelength is a wavelength λa1, a second recording layer of which an absorption wavelength is a wavelength λa2 (λa2<λa1), and a third recording layer of which an absorption wavelength is a wavelength λa3 (λa3<λa2) in this order from a side of a base material of the reversible recording medium, the light source section is provided with, as the one laser device, a third laser device of which an emission wavelength is λb3 (λa2−10 nm<λ3<λa2+10 nm), and an identifier of the third laser device is stored as the second identifier in the storage section.

(6)

The erasing unit according to (3), in which the reversible recording medium corresponding to the first identifier received by the receiving section is provided with, as a plurality of the recording layers, a first recording layer of which an absorption wavelength is a wavelength λa1, a second recording layer of which an absorption wavelength is a wavelength λa2 (λa2<λa1), and a third recording layer of which an absorption wavelength is a wavelength λa3 (λa3<λa2) in this order from a side of a base material of the reversible recording medium, the light source section is provided with, as the one laser device, a fourth laser device of which an emission wavelength is λb4 (λa3−10 nm<λb4<λa3+10 nm), and an identifier of the fourth laser device is stored as the second identifier in the storage section.

(7)

The erasing unit according to (3), in which the reversible recording medium corresponding to the first identifier received by the receiving section is provided with, as a plurality of the recording layers, a first recording layer of which an absorption wavelength is a wavelength λa1, a second recording layer of which an absorption wavelength is a wavelength λa2 (λa2<λa1), and a third recording layer of which an absorption wavelength is a wavelength λa3 (λa3<λa2) in this order from a side of a base material of the reversible recording medium, the light source section is provided with, as the plurality of laser devices, a fifth laser device of which an emission wavelength is λb5 (λa3<λb5<λa2) and a sixth laser device of which an emission wavelength is λb6 (λa1−10 nm<λb6<λa1+10 nm), and identifiers of the fifth laser device and the sixth laser device are stored as the second identifier in the storage section.

(8)

An erasing method, the erasing method for a reversible recording medium including recording layers and heat-insulating layers alternately stacked, the recording layers each including a reversible heat-sensitive color developing composition and a photothermal conversion agent, developing colors of the respective reversible heat-sensitive color developing compositions differing among the recording layers, absorption wavelengths of the respective photothermal conversion agents differing among the recording layers, the erasing method including:

performing erasing of information written on the reversible recording medium by applying, to the reversible recording medium, a smaller number of laser light beams having emission wavelengths than a number of the recording layers included in the reversible recording medium.

(9)

The erasing method according to (8), in which the reversible recording medium is provided with, as a plurality of the recording layers, a first recording layer of which an absorption wavelength is a wavelength λa1, a second recording layer of which an absorption wavelength is a wavelength λa2 (λa2<λa1), and a third recording layer of which an absorption wavelength is a wavelength λa3 (λa3<λa2), and the erasing method including using a first laser light beam of which an emission wavelength is λb1 (λa2<λb1<λa1) and a second laser light beam of which an emission wavelength is λb2 (λa3<λa2<λa2) for application of the laser light beams to the reversible recording medium.

(10)

The erasing method according to (8), in which the reversible recording medium is provided with, as a plurality of the recording layers, a first recording layer of which an absorption wavelength is a wavelength λa1, a second recording layer of which an absorption wavelength is a wavelength λa2 (λa2<λa1), and a third recording layer of which an absorption wavelength is a wavelength λa3 (λa3<λa2) in this order from a side of a base material of the reversible recording medium, and the erasing method includes using a third laser light beam of which an emission wavelength is λb3 (λa2−10 nm<λb3<+10 nm) for application of the laser light beams to the reversible recording medium.

(11)

The erasing method according to (8), in which the reversible recording medium is provided with, as a plurality of the recording layers, a first recording layer of which an absorption wavelength is a wavelength λa1, a second recording layer of which an absorption wavelength is a wavelength λa2 (λa2<λa1), and a third recording layer of which an absorption wavelength is a wavelength λa3 (λa3<λa2) in this order from a side of a base material of the reversible recording medium, and the erasing method includes using a fourth laser light beam of which an emission wavelength is λb4 (λa3−10 nm<λb4<λa3+10 nm) for application of the laser light beams to the reversible recording medium.

(12)

The erasing method according to (8), in which the reversible recording medium is provided with, as a plurality of the recording layers, a first recording layer of which an absorption wavelength is a wavelength λa1, a second recording layer of which an absorption wavelength is a wavelength λa2 (λa2<λa1), and a third recording layer of which an absorption wavelength is a wavelength λa3 (λa3<λa2) in this order from a side of a base material of the reversible recording medium, and the erasing method includes using a fifth laser light beam of which an emission wavelength is λb5 (λa3<λb5<λa2) and a sixth laser light beam of which an emission wavelength is λb6 (λa1−10 nm<λb6<λa1+10 nm) for application of the laser light beams to the reversible recording medium.

This application claims the benefit of Japanese Priority Patent Application JP2017-120739 filed with the Japan Patent Office on Jun. 20, 2017, the entire contents of which are incorporated herein by reference.

It should be understood by those skilled in the art that various modifications, combinations, sub-combinations, and alterations may occur depending on design requirements and other factors insofar as they are within the scope of the appended claims or the equivalents thereof.

The invention claimed is:

1. An erasing unit, the erasing unit that performs erasing of information written on a reversible recording medium, the reversible recording medium including recording layers and heat-insulating layers alternately stacked, the recording layers each including a reversible heat-sensitive color developing composition and a photothermal conversion agent, developing colors of the respective reversible heat-sensitive color developing compositions differing among the recording layers, absorption wavelengths of the respective photothermal conversion agents differing among the recording layers, the erasing unit comprising:

a light source section including one or a plurality of laser devices;

a controller that controls the light source section to cause the light source section to apply, to the reversible recording medium, a smaller number of laser light beams having emission wavelengths than a number of the recording layers included in the reversible recording medium; and a receiving section that receives an input of a first identifier that identifies a type of the reversible recording medium, wherein the controller controls the light source section to cause the light source section to apply, to the reversible recording medium, a smaller number of laser light beams having emission wavelengths than a number of the recording layers included in the reversible recording medium corresponding to the first identifier received by the receiving section.

2. The erasing unit according to claim 1, further comprising a storage section that stores the first identifier and a second identifier that identifies the one or plurality of laser devices included in the light source section, the first identifier and the second identifier being associated with each other, wherein the controller reads out, from the storage section, the second identifier associated with the first identifier received by the receiving section, and drives, of the one or plurality of laser devices included in the light source section, one or a plurality of first laser devices corresponding to the second identifier read out from the storage section.

3. The erasing unit according to claim 2, wherein the reversible recording medium corresponding to the first identifier received by the receiving section is provided with, as a plurality of the recording layers, a first recording layer of which an absorption wavelength is a wavelength $\lambda a1$, a second recording layer of which an absorption wavelength is a wavelength $\lambda a2$ ($\lambda a2<\lambda a1$), and a third recording layer of which an absorption wavelength is a wavelength $\lambda a3$ ($\lambda a3<\lambda a2$), the light source section is provided with, as the plurality of laser devices, a first laser device of which an emission wavelength is $\lambda b1$ ($\lambda a2<\lambda b1<\lambda a1$) and a second laser device of which an emission wavelength is $\lambda b2$ ($\lambda a3<\lambda b2<\lambda a2$), and identifiers of the first laser device and the second laser device are stored as the second identifier in the storage section.

4. The erasing unit according to claim 2, wherein the reversible recording medium corresponding to the first identifier received by the receiving section is provided with, as a plurality of the recording layers, a first recording layer of which an absorption wavelength is a wavelength $\lambda a1$, a second recording layer of which an absorption wavelength is a wavelength $\lambda a2$ ($\lambda a2<\lambda a1$), and a third recording layer of which an absorption wavelength is a wavelength $\lambda a3$ ($\lambda a3<\lambda a2$) in this order from a side of a base material of the reversible recording medium, the light source section is provided with, as the one laser device, a third laser device of which an emission wavelength is $\lambda b3$ ($\lambda a2-10$ nm$<\lambda b3<\lambda a2+10$ nm), and an identifier of the third laser device is stored as the second identifier in the storage section.

5. The erasing unit according to claim 2, wherein the reversible recording medium corresponding to the first identifier received by the receiving section is provided with, as a plurality of the recording layers, a first recording layer of which an absorption wavelength is a wavelength $\lambda a1$, a second recording layer of which an absorption wavelength is a wavelength $\lambda a2$ ($\lambda a2<\lambda a1$), and a third recording layer of which an absorption wavelength is a wavelength $\lambda a3$ ($\lambda a3<\lambda a2$) in this order from a side of a base material of the reversible recording medium, the light source section is provided with, as the one laser device, a fourth laser device of which an emission wavelength is $\lambda b4$ ($\lambda a3-10$ nm$<\lambda b4<\lambda a3+10$ nm), and an identifier of the fourth laser device is stored as the second identifier in the storage section.

6. The erasing unit according to claim 2, wherein the reversible recording medium corresponding to the first identifier received by the receiving section is provided with, as a plurality of the recording layers, a first recording layer of which an absorption wavelength is a wavelength $\lambda a1$, a second recording layer of which an absorption wavelength is a wavelength $\lambda a2$ ($\lambda a2<\lambda a1$), and a third recording layer of which an absorption wavelength is a wavelength $\lambda a3$ ($\lambda a3<\lambda a2$) in this order from a side of a base material of the reversible recording medium, the light source section is provided with, as the plurality of laser devices, a fifth laser device of which an emission wavelength is $\lambda b5$ ($\lambda a3<\lambda b5<\lambda a2$) and a sixth laser device of which an emission wavelength is $\lambda b6$ ($\lambda a1-10$ nm$<\lambda b6<\lambda a1+10$ nm), and identifiers of the fifth laser device and the sixth laser device are stored as the second identifier in the storage section.

7. An erasing method, the erasing method for a reversible recording medium including recording layers and heat-insulating layers alternately stacked, the recording layers each including a reversible heat-sensitive color developing composition and a photothermal conversion agent, developing colors of the respective reversible heat-sensitive color developing compositions differing among the recording layers, absorption wavelengths of the respective photothermal conversion agents differing among the recording layers, the erasing method comprising:

performing erasing of information written on the reversible recording medium by applying, to the reversible recording medium, a smaller number of laser light beams having emission wavelengths than a number of the recording layers included in the reversible recording medium, wherein the reversible recording medium is provided with, as a plurality of the recording layers, a first recording layer of which an absorption wavelength is a wavelength $\lambda a1$, a second recording layer of which an absorption wavelength is a wavelength $\lambda a2$ ($\lambda a2<\lambda a1$), and a third recording layer of which an absorption wavelength is a wavelength $\lambda a3$ ($\lambda a3<\lambda a2$), and the erasing method comprises using a first laser light beam of which an emission wavelength is $\lambda b1$ ($\lambda a2<\lambda b1<\lambda a1$) and a second laser light beam of which an emission wavelength is $\lambda b2$ ($\lambda a3<\lambda b2<\lambda a2$) for application of the laser light beams to the reversible recording medium.

8. An erasing method, the erasing method for a reversible recording medium including recording layers and heat-insulating layers alternately stacked, the recording layers each including a reversible heat-sensitive color developing composition and a photothermal conversion agent, developing colors of the respective reversible heat-sensitive color developing compositions differing among the recording layers, absorption wavelengths of the respective photothermal conversion agents differing among the recording layers, the erasing method comprising:

performing erasing of information written on the reversible recording medium by applying, to the reversible recording medium, a smaller number of laser light beams having emission wavelengths than a number of the recording layers included in the reversible recording medium, wherein the reversible recording medium is provided with, as a plurality of the recording layers, a first recording layer of which an absorption wavelength is a wavelength $\lambda a1$, a second recording layer of which an absorption wavelength is a wavelength $\lambda a2$ ($\lambda a2<\lambda a1$), and a third recording layer of which an absorption wavelength is a wavelength $\lambda a3$ ($\lambda a3<\lambda a2$) in this order from a side of a base material of the reversible recording medium, and the erasing method comprises using a third laser light beam of which an emission wavelength is $\lambda b3$ ($\lambda a2-10$ nm$<\lambda b3<\lambda a2+10$ nm) for application of the laser light beams to the reversible recording medium.

9. An erasing method, the erasing method for a reversible recording medium including recording layers and heat-insulating layers alternately stacked, the recording layers each including a reversible heat-sensitive color developing composition and a photothermal conversion agent, developing colors of the respective reversible heat-sensitive color developing compositions differing among the recording layers, absorption wavelengths of the respective photothermal conversion agents differing among the recording layers, the erasing method comprising:

performing erasing of information written on the reversible recording medium by applying, to the reversible recording medium, a smaller number of laser light beams having emission wavelengths than a number of the recording layers included in the reversible recording medium, wherein the reversible recording medium is provided with, as a plurality of the recording layers, a first recording layer of which an absorption wavelength is a wavelength $\lambda a1$, a second recording layer of which an absorption wavelength is a wavelength $\lambda a2$ ($\lambda a2<\lambda a1$), and a third recording layer of which an absorption wavelength is a wavelength $\lambda a3$ ($\lambda a3<\lambda a2$) in this order from a side of a base material of the reversible recording medium, and the erasing method comprises using a fourth laser light beam of which an emission wavelength is $\lambda b4$ ($\lambda a3-10$ nm$<\lambda b4<\lambda a3+10$ nm) for application of the laser light beams to the reversible recording medium.

10. An erasing method, the erasing method for a reversible recording medium including recording layers and heat-insulating layers alternately stacked, the recording layers each including a reversible heat-sensitive color developing composition and a photothermal conversion agent, developing colors of the respective reversible heat-sensitive color developing compositions differing among the recording layers, absorption wavelengths of the respective photothermal conversion agents differing among the recording layers, the erasing method comprising:

performing erasing of information written on the reversible recording medium by applying, to the reversible recording medium, a smaller number of laser light beams having emission wavelengths than a number of the recording layers included in the reversible recording medium, wherein the reversible recording medium is provided with, as a plurality of the recording layers, a first recording layer of which an absorption wavelength is a wavelength $\lambda a1$, a second recording layer of which an absorption wavelength is a wavelength $\lambda a2$ ($\lambda a2<\lambda a1$), and a third recording layer of which an absorption wavelength is a wavelength $\lambda a3$ ($\lambda a3<\lambda a2$) in this order from a side of a base material of the reversible recording medium, and the erasing method comprises using a fifth laser light beam of which an emission wavelength is $\lambda b5$ ($\lambda a3<\lambda b5<\lambda a2$) and a sixth laser light beam of which an emission wavelength is $\lambda b6$ ($\lambda a1-10$ nm$<\lambda b6<\lambda a1+10$ nm) for application of the laser light beams to the reversible recording medium.

* * * * *